US008712261B2

(12) United States Patent
Kudo et al.

(10) Patent No.: US 8,712,261 B2
(45) Date of Patent: Apr. 29, 2014

(54) LUBRICANT SUPPLYING DEVICE, PROCESS CARTRIDGE, AND IMAGE FORMING APPARATUS

(75) Inventors: Norio Kudo, Kanagawa (JP); Shinichi Kawahara, Tokyo (JP); Nobuo Kuwabara, Kanagawa (JP); Takeshi Shintani, Kanagawa (JP); Akio Kosuge, Kanagawa (JP); Daisuke Tomita, Kanagawa (JP); Makoto Yasuda, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 144 days.

(21) Appl. No.: 13/524,740

(22) Filed: Jun. 15, 2012

(65) Prior Publication Data

US 2012/0321330 A1 Dec. 20, 2012

(30) Foreign Application Priority Data

Jun. 17, 2011 (JP) ..... 2011-134833
May 8, 2012 (JP) ..... 2012-106498

(51) Int. Cl.
*G03G 15/00* (2006.01)

(52) U.S. Cl.
USPC ..... 399/43; 399/346

(58) Field of Classification Search
CPC ..... G03G 15/55; G03G 15/553
USPC ..... 399/43, 346
See application file for complete search history.

(56) References Cited

U.S. PATENT DOCUMENTS

2007/0253726 A1* 11/2007 Kagawa ..... 399/100
2009/0003858 A1* 1/2009 Nishida ..... 399/48
2009/0097879 A1 4/2009 Nagashima et al.
2009/0214253 A1* 8/2009 Murao ..... 399/101
2010/0183349 A1* 7/2010 Shintani et al. ..... 399/346
2010/0189461 A1* 7/2010 Shintani et al. ..... 399/94
2011/0176845 A1* 7/2011 Kanazawa et al. ..... 399/346
2011/0217101 A1* 9/2011 Okamoto et al. ..... 399/346
2011/0229195 A1* 9/2011 Matsuura ..... 399/111
2011/0229232 A1* 9/2011 Kojima et al. ..... 399/346
2011/0268466 A1* 11/2011 Kimura et al. ..... 399/71
2012/0315053 A1* 12/2012 Kudo et al. ..... 399/44

FOREIGN PATENT DOCUMENTS

JP 2001-305907 11/2001
JP 2007164105 A * 6/2007
JP 2007-193263 8/2007
JP 2007193263 A * 8/2007
JP 2010-210799 9/2010

* cited by examiner

*Primary Examiner* — G. M. Hyder

(74) *Attorney, Agent, or Firm* — Oblon, Spivak, McClelland, Maier & Neustadt, L.L.P.

(57) ABSTRACT

A lubricant supplying device includes a lubricant supplying roller configured to rotate in a certain direction and makes a sliding contact with an image carrier on which a toner image is carried; a solid lubricant arranged to slide in contact with the lubricant supplying roller; a changing unit configured to change a revolution of the lubricant supplying roller to adjust an amount of the solid lubricant supplied onto the image carrier; and a calculation unit configured to obtain a product life or total consumption of the solid lubricant from a total running distance or total operating time of the image carrier or the lubricant supplying roller, the product life or the total consumption of the solid lubricant being corrected based on the amount of the solid lubricant supplied onto the image carrier.

13 Claims, 7 Drawing Sheets

| TOTAL RUNNING DISTANCE | INITIAL STAGE (0 TO A km) | LAPSED PERIOD (MORE THAN A km) |
|---|---|---|
| REVOLUTION OF LUBRICANT SUPPLYING ROLLER | $\alpha$ | $1.2 \times \alpha$ |

| ABSOLUTE HUMIDITY | LOW | MODERATE | HIGH |
|---|---|---|---|
| REVOLUTION OF LUBRICANT SUPPLYING ROLLER | $0.8 \times \alpha$ | $\alpha$ | $1.2 \times \alpha$ |

FIG.8

| | STANDARD MODE | SPECIAL MODE |
|---|---|---|
| NORMAL STATE | 1.0 | 1.45 |
| WINTER ENVIRONMENT | 1.32 | 1.74 |
| CONTINUOUS SHEET FEEDING | 1.24 | 1.62 |
| WINTER ENVIRONMENT+CONTINUOUS SHEET FEEDING | 1.51 | 1.67 |

FIG.9

| TOTAL RUNNING DISTANCE | INITIAL STAGE | LAPSED PERIOD | | |
|---|---|---|---|---|
| | 0 TO A1 km | A1 TO A2 km | A2 TO A3 km | MORE THAN 3 km |
| REVOLUTION OF LUBRICANT SUPPLYING ROLLER | $\alpha$ | $1.1 \times \alpha$ | $1.2 \times \alpha$ | $1.3 \times \alpha$ |

FIG.10

| ABSOLUTE HUMIDITY | LOW | MODERATE | HIGH |
|---|---|---|---|
| REVOLUTION OF LUBRICANT SUPPLYING ROLLER | $\alpha$ | $\alpha$ | $1.2 \times \alpha$ |

FIG.11

| | CORRECTION COEFFICIENT |
|---|---|
| STANDARD ENVIRONMENT | 1.0 |
| SUMMER ENVIRONMENT | 0.8 |
| WINTER ENVIRONMENT+REVOLUTION IS CHANGED | 1.2 |
| WINTER ENVIRONMENT+REVOLUTION IS FIXED | 1.2 |

LUBRICANT SUPPLYING DEVICE, PROCESS CARTRIDGE, AND IMAGE FORMING APPARATUS

CROSS-REFERENCE TO RELATED APPLICATIONS

The present application claims priority to and incorporates by reference the entire contents of Japanese Patent Application No. 2011-134833 filed in Japan on Jun. 17, 2011 and Japanese Patent Application No. 2012-106498 filed in Japan on May 8, 2012.

BACKGROUND OF THE INVENTION

1. Field of the Invention

The present invention relates to a lubricant supplying device, a process cartridge, and an image forming apparatus.

2. Description of the Related Art

For use in image forming apparatuses such as copying machines and printers, techniques have been known that use lubricant supplying devices for supplying lubricant onto image carriers such as photosensitive drums and intermediate transfer belts. For example, refer to Japanese Patent Application Laid-open No. 2001-305907, Japanese Patent Application Laid-open No. 2007-193263, and Japanese Patent Application Laid-open No. 2010-210799.

In an example of such copying machines, non-transferred toner remaining on the photosensitive drum after a transfer process needs to be completely removed by a cleaning blade (cleaning device) making contact with the photosensitive drum. However, when abrasion occurs at the contact portion of the cleaning blade due to friction with the photosensitive drum, the non-transferred toner passes through a gap, due to abrasion, between the cleaning blade and the photosensitive drum, thereby causing a cleaning failure due to the passed-through non-transferred toner or filming (fusion) of the passed-through non-transferred toner onto the photosensitive drum.

For addressing such problems, lubricant is applied onto the photosensitive drum to reduce a friction coefficient on the photosensitive drum, thereby lessening wear and abrasion of the cleaning blade and the deterioration of the photosensitive drum. As a result, cleaning failure and filming occurring over time can be suppressed.

Specifically, in Japanese Patent Application Laid-open No. 2001-305907, a lubricant supplying device includes a brush roller (lubricant supplying roller) that slides in contact with a photosensitive drum belt (image carrier), solid lubricant making contact with the brush roller, and a compression spring urging the solid lubricant toward the brush roller in a press-contact direction. The lubricant is gradually scraped from the solid lubricant by the brush roller rotating in a certain direction. The lubricant scraped and conveyed by the brush roller is applied (supplied) on a surface of the image carrier.

In Japanese Patent Application Laid-open No. 2007-193263, a technique is disclosed that calculates consumption of lubricant from the total revolution of a photosensitive drum (image carrier). In Japanese Patent Application Laid-open No. 2010-210799, a technique is disclosed in which a drive system for a lubricant supplying roller (rotating brush) is provided independently from other drive systems.

Conventional lubricant supplying devices have problems in that supplying amounts of lubricant supplied on the image carriers change because of environmental fluctuations and because of lapse of time. If such problems occur, the supplying amounts of lubricant supplied by the lubricant supplying devices on the image carriers become insufficient, thereby causing abrasion of the cleaning blades, cleaning failures, and filming.

For solving such problems, the lubricant supplying amount may be adjusted by changing the revolution of the lubricant supplying roller when environmental fluctuations occur and over time. In this case, however, the exact product life or total consumption of the solid lubricant cannot be calculated by applying the techniques disclosed in Japanese Patent Application Laid-open No. 2007-193263 and Japanese Patent Application Laid-open No. 2010-210799. As a result, the solid lubricant having a remaining product life is replaced too early or a lubricant supplying failure occurs due to overlooking the time for replacing the solid lubricant.

Therefore, there is a need for a lubricant supplying device that can supply lubricant consistently and stably onto an image carrier without being insufficient in the supply of the lubricant on the image carrier even when environmental fluctuations occur and even over time, and that can correctly obtain a product life or total consumption of a solid lubricant, further providing a process cartridge including the lubricant supplying device, and an image forming apparatus including the process cartridge.

SUMMARY OF THE INVENTION

It is an object of the present invention to at least partially solve the problems in the conventional technology.

According to an embodiment, there is provided a lubricant supplying device that includes a lubricant supplying roller configured to rotate in a certain direction and makes a sliding contact with an image carrier on which a toner image is carried; a solid lubricant arranged to slide in contact with the lubricant supplying roller; a changing unit configured to change a revolution of the lubricant supplying roller to adjust an amount of the solid lubricant supplied onto the image carrier; and a calculation unit configured to obtain a product life or total consumption of the solid lubricant from a total running distance or total operating time of the image carrier or the lubricant supplying roller, the product life or the total consumption of the solid lubricant being corrected based on the amount of the solid lubricant supplied onto the image carrier.

According to another embodiment, there is provided a process cartridge that is attached to an image forming apparatus so as to be detachable and includes the lubricant supplying device according to the above embodiment; and the image carrier.

According to still another embodiment, there is provided an image forming apparatus that includes the lubricant supplying device according to the above embodiment; and the image carrier.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 8 is a table illustrating correction coefficients of the total running distance under a winter environment, continuous sheet feeding, and a special mode;

FIG. 9 is a table relating to variable control of the revolution of the lubricant supplying roller in association with an increase in the total running distance, as a modified example;

FIG. 10 is a table relating to variable control of the revolution of the lubricant supplying roller in association with a change in the absolute humidity, as a modified example; and FIG. 11 is a table illustrating correction coefficients of the total running distance when the revolution of the lubricant supplying roller fluctuates under a summer environment, when the revolution of the lubricant supplying roller is changed under the winter environment, and when the revolution of the lubricant supplying roller is fixed under the winter environment.

DETAILED DESCRIPTION OF THE PREFERRED EMBODIMENTS

Figure 1:
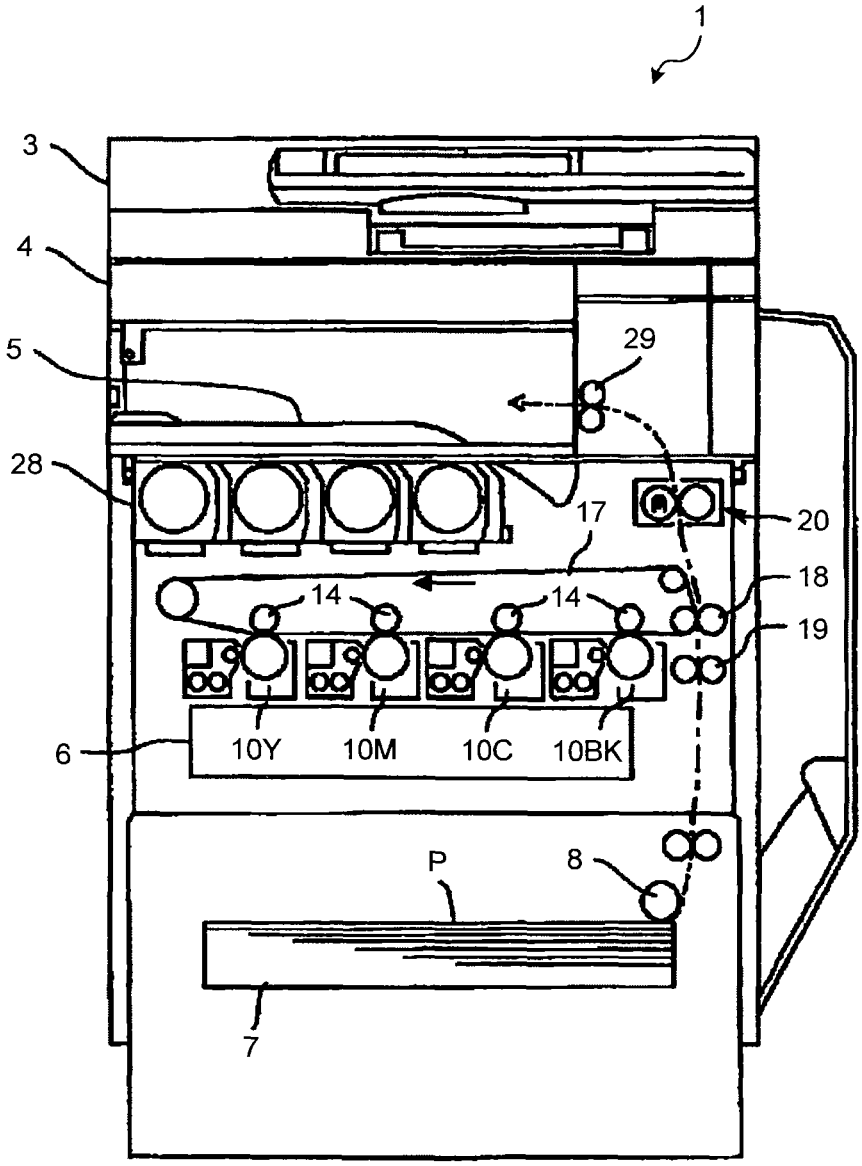
FIG. 1 is an overall structural diagram illustrating an image forming apparatus according to an embodiment of the invention.

Embodiments of the invention will be described in detail below with reference to the accompanying drawings. In the drawings, the same or equivalent components are denoted by the same reference numerals, and duplicated explanations thereof are simplified or omitted.

A structure and operation of an image forming apparatus are described with reference to FIG. 1.

An image forming apparatus 1 according to an embodiment is an electrophotography apparatus such as a copying machine, a printer, a facsimile, or a multifunction peripheral thereof. The image forming apparatus 1 is a tandem type color image forming apparatus, in which a plurality of process cartridges 10Y, 10M, 10C, and 10BK serving as image forming units are arranged in parallel so as to face an intermediate transfer belt 17.

As illustrated in FIG. 1, the image forming apparatus 1, which is a color copying machine, includes a document feeding unit 3 that feeds a document to a document reading unit 4, the document reading unit 4 that reads image information of the document, a writing unit (exposing unit) 6 that emits laser beams based on the input image information, a paper feeding unit 7 that stores a recording medium P such as a transfer sheet, the process cartridges 10Y, 10M, 10C, and 10BK serving as the image forming units for respective colors (yellow, magenta, cyan, and black), the intermediate transfer belt 17 on which toner images of the colors are superimposed and transferred, a secondary transfer roller 18 that transfers the toner images formed on the intermediate transfer belt 17 onto the recording medium P, a fixing unit 20 that fixes a non-fixed image on the recording medium P, toner containers 28 that supply toner of the respective colors to corresponding developing units of the respective process cartridges (image forming units) 10Y, 10M, 100, and 10BK.

Figure 2:
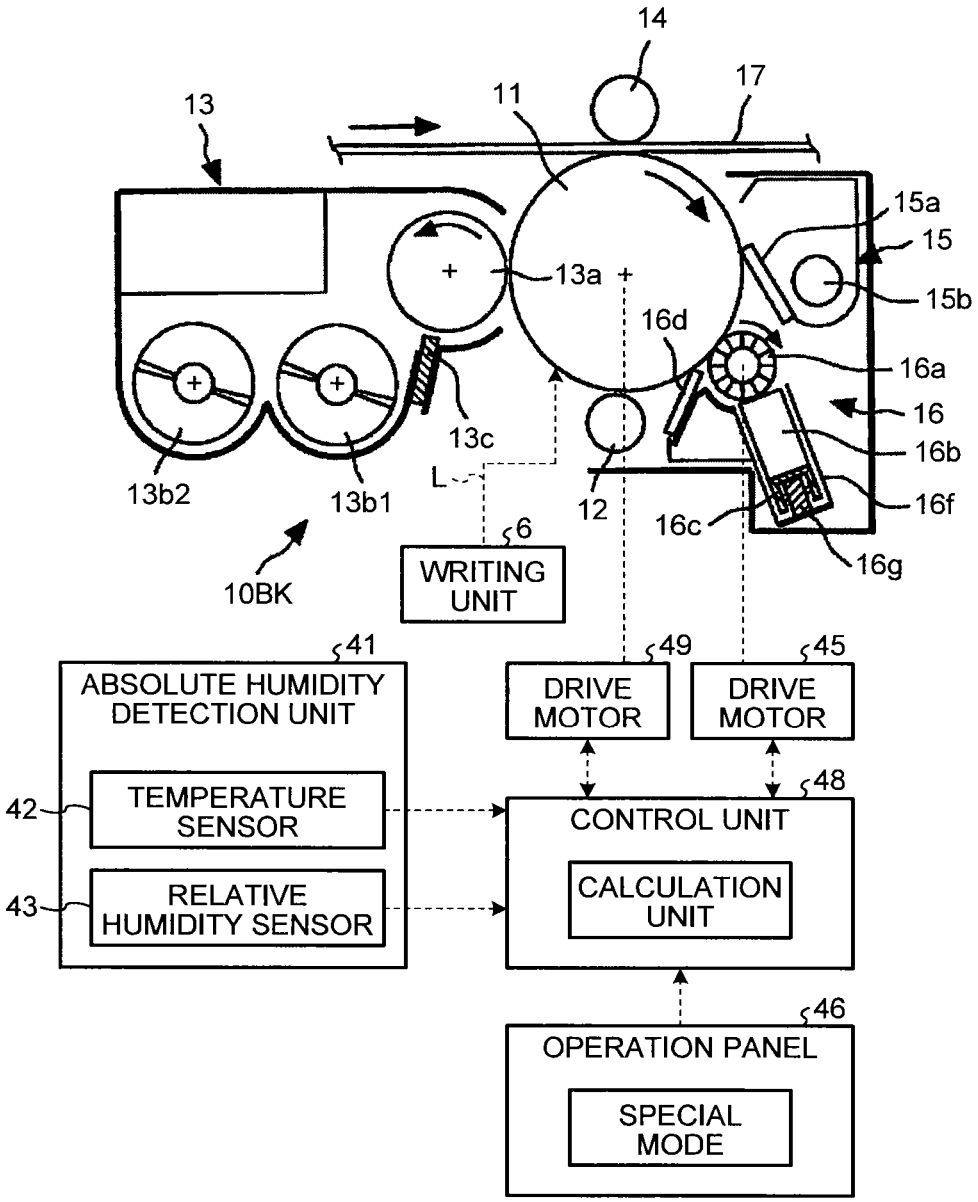
FIG. 2 is a structural view illustrating an image forming unit.

Each of the process cartridges (image forming units) 10Y, 10M, 100, and 10BK includes a photosensitive drum 11 serving as an image carrier, a charging unit 12, a developing unit 13 (developing device), a cleaning unit 15 (cleaning device), a lubricant supplying device 16 (lubricant supplying unit) as an integrated unit (refer to FIG. 2). Each of the process cartridges 10Y, 10M, 100, and 10BK is taken out from the image forming apparatus 1 and replaced with a new one when it reaches its product life.

The toner images of the respective colors (yellow, magenta, cyan, and black) are formed on the corresponding photosensitive drums 11 (image carriers) of the respective process cartridges 10Y, 10M, 100, and 10BK.

The operation of the image forming apparatus 1 when color images are formed in normal operation is described below.

A document is fed from a document table by a feeding roller of the document feeding unit 3 and placed on a contact glass of the document reading unit 4. The document reading unit 4 optically reads image information of the document placed on the contact glass.

Specifically, the document reading unit 4 reads images of the document placed on the contact glass while emitting light from a lighting lamp. Light reflected by the document is imaged on a color sensor through a mirror group and lenses. The color image information of the document is read by the color sensor for each color separation light component of RGB (red, green, and blue) and thereafter converted into electrical image signals. Each color separation image signal of RGB is subjected to processing such as color conversion, color correction, and space frequency correction by an image processing unit (not illustrated), resulting in color image information of yellow, magenta, cyan, and black being obtained.

The image information of yellow, magenta, cyan, and black is sent to the writing unit 6. The writing unit 6 emits laser beams (exposing light) toward the corresponding photosensitive drums 11 of the respective process cartridges 10Y, 10M, 10C, and 10BK on the basis of the image information of each color.

Each of the four photosensitive drums 11 rotates clockwise as illustrated in FIG. 2. The surface of the photosensitive drum 11 is uniformly charged at a position facing a roller charging device 12 (the charging unit) (a charging process). As a result, charged potential is formed on the photosensitive drum 11. Then, the charged surface of the photosensitive drum 11 reaches a position where the surface is irradiated with a corresponding laser beam.

In the writing unit 6, a light source emits laser beams in the respective colors corresponding to the image signals. The laser beams enter a polygon mirror, are reflected by the polygon mirror, and thereafter pass through a plurality of lenses (not illustrated). The laser beams pass through different optical paths for each of the color component of yellow, magenta, cyan, and black after passing through the lenses (an exposing process).

The laser beam corresponding to the yellow component is applied on the surface of the photosensitive drum 11 of the first process cartridge 10Y from the left of the sheet surface. The laser beam corresponding to the yellow component is scanned in a rotational axis direction (main-scanning direction) of the photosensitive drum 11 by the polygon mirror rotating at a high speed (not illustrated). As a result, a static latent image corresponding to the yellow component is formed on the photosensitive drum 11 after being charged by the roller charging device 12.

Likewise, the laser beam corresponding to the magenta component is applied on the surface of the photosensitive drum 11 of the second process cartridge 10M from the left of the sheet surface, and a static latent image of the magenta component is formed. The laser beam corresponding to the cyan component is applied on the surface of the photosensitive drum 11 of the third process cartridge 10C from the left of the sheet surface, and a static latent image of the cyan component is formed. The laser beam corresponding to the black component is applied on the surface of the photosensitive drum 11 of the fourth process cartridge 10BK (image forming unit for black) from the left of the sheet surface (located at the most downstream position in a running direction of the intermediate transfer belt 17), and a static latent image of the black component is formed.

Thereafter, the surfaces of the photosensitive drums 11 on which the static latent images of the respective colors have been formed reach positions facing the corresponding developing units 13. Then, the developing units 13 supply toner of the respective colors to the corresponding photosensitive drums 11 and the latent images on the photosensitive drums 11 are developed (a developing process).

Thereafter, the surfaces of the photosensitive drums 11 after the developing process reach respective positions facing the intermediate transfer belt 17. Primary transfer rollers 14 are disposed at the respective facing positions so as to make contact with the inner circumference surface of the intermediate transfer belt 17. The toner images of the respective colors formed on the respective photosensitive drums 11 are sequentially transferred and superimposed on the intermediate transfer belt 17 at the respective positions of the primary transfer rollers 14 (a primary transfer process).

Thereafter, the surfaces of the photosensitive drums 11 after the primary transfer process reach respective positions facing the corresponding cleaning units 15. The cleaning units 15 collect non-transferred toner remaining on the photosensitive drums 11 (a cleaning process).

Thereafter, the surfaces of the photosensitive drums 11 sequentially pass the respective positions of the lubricant supplying devices 16 and neutralization units (not illustrated). In this manner, a series of image forming processes performed on the photosensitive drums 11 is completed.

On the other hand, the surface of the intermediate transfer belt 17 on which the respective color images on the photosensitive drums 11 are transferred and superimposed, runs in an arrow direction in FIG. 1 and reaches a position of the secondary transfer roller 18. The full-color image on the intermediate transfer belt 17 is secondarily transferred onto the recording medium P at the position of the secondary transfer roller 18 (a secondary transfer process).

Thereafter, the surface of the intermediate transfer belt 17 arrives at a position of an intermediate transfer belt cleaning unit (not illustrated). The intermediate transfer belt cleaning unit collects non-transferred toner remaining on the intermediate transfer belt 17. In this manner, a series of transfer processes performed on the intermediate transfer belt 17 is completed.

The recording medium P at the position of the secondary transfer roller 18 has been fed from the paper feeding unit 7 through a feeding guide and registration rollers 19, for example.

Specifically, a transfer sheet P is fed by a paper feeding roller 8 from the paper feeding unit 7 storing the recording medium P and guided to the registration rollers 19 after passing through the feeding guide. Upon reaching the registration rollers 19, the recording medium P is conveyed toward the position of the secondary transfer roller 18 in synchronization with the operation timing of conveying the toner images on the intermediate transfer belt 17.

Then, the recording medium P on which the full-color image has been transferred is guided to the fixing unit 20. The fixing unit 20 fixes the color image on the recording medium P in a nip between a fixing roller and a pressing roller.

After the fixing process, the recording medium P is discharged outside the image forming apparatus 1 by discharging rollers 29 as an output image and thereafter stacked on a discharging unit 5. In this manner, a series of image forming processes is completed.

The image forming unit of the image forming apparatus is described below in detail with reference to FIG. 2.

FIG. 2 is a structural view illustrating the process cartridge 10BK (process cartridge for monochrome copying) serving as the image forming unit for black. The process cartridge 10BK for monochrome copying and the process cartridges 10Y, 10M, and 10C for color copying are structured by almost the same components except for that colors of toner used for image forming processes differ from each other. Thus, the descriptions and illustrations of the process cartridges 10Y, 10M, and 10C for color copying are omitted.

As illustrated in FIG. 2, the process cartridge 10BK integrally houses in a case the photosensitive drum 11 serving as the image carrier, the charging unit 12 (roller charging device) charging the photosensitive drum 11, the developing unit 13 developing static images formed on the photosensitive drum 11, the cleaning unit 15 collecting non-transferred toner remaining on the photosensitive drum 11, and the lubricant supplying device 16 supplying lubricant onto the photosensitive drum 11.

The photosensitive drum 11 serving as the image carrier is an organic photosensitive drum having a negative charging property and is structured in such a manner that a photosensitive layer is provided on a conductive supporting body having a drum shape, for example.

In the photosensitive drum 11, an under coating layer serving as an insulation layer, a charge generation layer and a charge transport layer that serve as the photosensitive layer, and a protective layer (surface layer) are sequentially layered on the conductive supporting body serving as a base layer (not illustrated).

Any conductive material having a volume resistivity equal to or less than $10^{10}$ Ω·cm can be used as the conductive supporting body (base layer) of the photosensitive drum 11.

The photosensitive drum 11 is rotated clockwise in FIG. 2 by a drive motor 49.

The charging unit 12 (roller charging device), which is a roller composed of a conductive cored bar and a mid-resistance elastic layer coated on the conductive cored bar, is disposed downstream from the lubricant supplying device 16 in a rotational direction of the photosensitive drum 11. The charging unit 12 (roller charging device) is disposed so as to face the photosensitive drum 11 without making contact with the photosensitive drum 11 to prevent the lubricant supplied onto the photosensitive drum 11 by the lubricant supplying device 16 from sticking to the charging unit 12.

A certain voltage (charging bias) is applied to the charging unit 12 from a power source unit (not illustrated), thereby uniformly charging the surface of the photosensitive drum 11 facing the charging unit 12.

The developing unit (developing device) 13 mainly includes a developing roller 13*a* facing the photosensitive drum 11, a first conveyor screw 13*b*1 facing the developing roller 13*a*, a second conveyor screw 13*b*2 facing the first conveyor screw 13*b*1 with a partition member interposed therebetween, and a doctor blade 13*c* facing the developing roller 13*a*. The developing roller 13*a* includes magnets fixed inside thereof so as to form magnetic poles on the circumferential surface thereof, and a sleeve rotating around the magnets. The magnets form magnetic poles on the developing roller 13*a* (the sleeve). As a result, developer is carried on the developing roller 13*a*.

The developing unit 13 contains a two-component type developer composed of carrier particles and toner.

For the sake of improved image quality, spherical toner having a degree of sphericity equal to or greater than 0.98 is used. The degree of sphericity is an average degree of sphericity measured by a flow type particle image analyzer "FPIA-2000" (available from Toa Medical Electronics Co., Ltd.). Specifically, a surfactant (preferably, alkyl benzene sulfonate) in an amount ranging from 0.1 to 0.5 mL is added as a dispersing agent in a container containing water in an amount ranging from 100 to 150 mL from which solid impurities have been removed, and a measurement sample (toner) in an amount ranging from about 0.1 to 0.5 g is added to the water. Thereafter, the suspension liquid in which the toner is dispersed for about 1 to 3 minutes by an ultrasonic disperser to produce a dispersion liquid having a concentration of about 3000 to 10000 particles per μL. The dispersion liquid is set to the analyzer to measure shapes of the toner particles and a toner particle shape distribution.

Toner obtained by a spheronization process, in which toner particles having variant distorted shapes manufactured by a crushing method having been widely used (crushed toner) are spheronized, and toner manufactured by a polymerization method can be used as the sphere toner, for example.

When such sphere toner is used, a cleaning failure may occur because the sphere toner enters and passes through a minimal gap between a cleaning blade 15*a* and the photosensitive drum 11. In the embodiment, the lubricant supplying device 16 applies lubricant on the surface of the photosensitive drum 11 to improve a toner peeling property (removal property) on the photosensitive drum 11, thereby suppressing the occurrence of the cleaning failure.

The cleaning unit 15 is disposed upstream from the lubricant supplying device 16 in the rotational direction of the photosensitive drum 11. The cleaning unit 15 includes the cleaning blade 15*a* that makes contact with the photosensitive drum 11 and a conveyor coil 15*b* that conveys the toner collected inside the cleaning unit 15 as waste toner toward a waste toner collection container (not illustrated). The cleaning blade 15*a* is made of a rubber material such as urethane rubber and makes contact with the surface of the photosensitive drum 11 at a certain angle and a certain pressure. As a result, an adhesion substance such as non-transferred toner adhering to the photosensitive drum 11 is mechanically scraped and collected inside the cleaning unit 15. Examples of adhesion substances adhering to the photosensitive drum 11 in addition to the non-transferred toner, include paper powder produced from the recording medium P (sheet), discharge products produced on the photosensitive drum 11 during discharge of the roller charging device 12, and additives added to the toner.

Figures 3, 4:
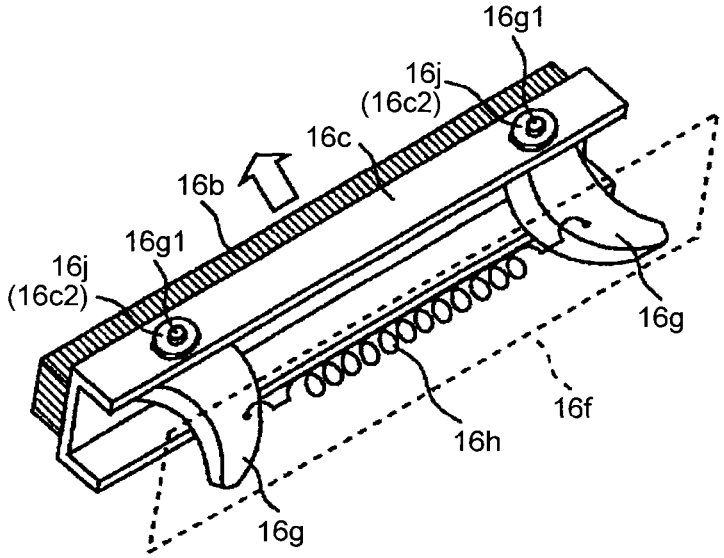
FIG. 3 is a perspective view illustrating a lubricant unit.
FIG. 4 is a table relating to variable control of the revolution of a lubricant supplying roller in association with an increase in a total running distance.

The lubricant supplying device 16 includes a solid lubricant 16*b*, a lubricant supplying roller 16*a* (brush roller) that makes a sliding contact with both the photosensitive drum 11 and the solid lubricant 16*b*, a holding member 16*c* that holds the solid lubricant 16*b*, a case 16*f* that houses the holding member 16*c* together with the solid lubricant 16*b*, and turning members 16*g* and a tension spring 16*h* that urge the solid lubricant 16*b* together with the holding member 16*c* toward the lubricant supplying roller 16*a*, as a pressuring mechanism, and also a blade-shaped member 16*d* that makes thin layers of the lubricant supplied on the photosensitive drum 11 by the lubricant supplying roller 16*a* (refer to FIG. 3). The blade-shaped member 16*d* is disposed downstream from the lubricant supplying roller 16*a* in the rotational direction of the photosensitive drum 11 and makes contact with the photosensitive drum 11 in the direction opposite the rotational direction of the photosensitive drum 11 (in a counter direction).

The lubricant supplying device 16 thus structured supplies the lubricant on the photosensitive drum 11 as a thin layer. The structure and operation of the lubricant supplying device 16 are described later in detail.

The image forming process is described further in detail with reference to FIG. 2.

The developing roller 13*a* rotates in the arrow direction (counter-clockwise) in FIG. 2. The developer in the developing unit 13 circulates along a longitudinal direction (the perpendicular direction to FIG. 2) together with the toner supplied from the toner container 28 by a toner supplying unit (not illustrated) by rotation of the first conveyor screw 13*b*1 and the second conveyor screw 13*b*2 that are arranged with the partition member interposed therebetween while being stirred and mixed.

The toner adhering to the carrier by triboelectric charging is carried on the developing roller 13*a* together with the carrier. Thereafter, the developer carried on the developing roller 13*a* reaches the position of the doctor blade 13*c*. The developer carried on the developing roller 13*a* is adjusted to an appropriate amount at the position of the doctor blade 13*c*. Thereafter, the developer carried on the developing roller 13*a* reaches the position facing the photosensitive drum 11 (a developing region).

In the developing region, the toner in the developer adheres to a static latent image formed on the surface of the photosensitive drum 11. Specifically, the toner adheres to the latent image (a toner image is formed) by an electrical field formed by a potential difference (development potential) between latent image potential (exposure potential) of an image area which is irradiated with a laser beam L and a developing bias applied to the developing roller 13*a*.

Then, most of the toner having adhered to the photosensitive drum 11 in the developing process is transferred onto the intermediate transfer belt 17. The non-transferred toner remaining on the photosensitive drum 11 is collected in the cleaning unit 15 by the cleaning blade 15*a*.

The toner supplying unit (not illustrated) provided in the image forming apparatus 1 includes the replaceable bottle-like toner containers 28 and bottle-like toner hoppers each of which holds and rotates the corresponding toner container 28 and supplies new toner to the corresponding developing unit 13. The toner container 28 contains new toner (any one of yellow, magenta, cyan, and black). The container (toner bottle) 28 has a spiral-shaped projection on an inner circumferential surface thereof.

The new toner in the toner container 28 is appropriately supplied into the developing unit 13 from a toner supplying port according to the consumption of the toner (toner having been supplied) in the developing unit 13. The consumption of the toner in the developing unit 13 is indirectly or directly detected by a reflective photo sensor disposed so as to face the photosensitive drum 11 and a magnetic sensor disposed under the second conveyor screw 13*b*2 of the developing unit 13 (not illustrated).

The structure and operation of the lubricant supplying device 16 (lubricant supplying unit) of the embodiment is described below in detail.

As illustrated in FIG. 2, the lubricant supplying device 16 includes the solid lubricant 16*b*, the lubricant supplying roller 16*a* (brush roller) that has brush bristles of provided around the periphery thereof and making a sliding contact with the photosensitive drum 11 and the solid lubricant 16*b*, the holding member 16*c* that holds the solid lubricant 16*b*, the case 16*f* that houses the holding member 16*c* together with the solid lubricant 16*b*, the turning members 16*g* and the tension spring 16*h* (the pressuring mechanism) that urge the solid lubricant 16*b* together with the holding member 16*c* toward the lubricant supplying roller 16*a*, and the blade-shaped member 16*d* (thin layer forming blade) that makes thin layers of the lubricant supplied on the photosensitive drum 11 by the lubricant supplying roller 16*a*.

The case 16*f*, which has a roughly box shape, houses the holding member 16*c* together with the solid lubricant 16*b* in such a manner that the solid lubricant 16*b* can move in a direction to press the lubricant supplying roller 16*a* (so as not to hinder the movement of the solid lubricant 16*b*) and is held by the lubricant supplying device 16 (the process cartridge 10BK). The case 16*f* has relatively small clearances with regard to the solid lubricant 16*b* and the holding member 16*c* to an extent of not hindering their movements in the pressing contact direction (in the direction along which the solid lubricant 16*b* presses the lubricant supplying roller 16*a*), thereby preventing in some degrees the solid lubricant 16*b* from being tilted when pressing the lubricant supplying roller 16*a*.

The lubricant supplying roller 16*a* (brush roller) is composed of a cored bar and a base cloth on which the bristles ranging from 0.2 to 20 mm (preferably from 0.5 to 10 mm) in length are implanted and that is spirally wound around the cored bar.

When the lengths of the bristles are more than 20 mm, the bristles are slanted in a certain direction due to repeated sliding and rubbing against the photosensitive drum 11 over time, thereby lowering the performance for scraping the solid lubricant 16*b* and for removing toner from the photosensitive drum 11. On the other hand, when the lengths of the bristles are less than 0.2 mm, physical contact force with the solid lubricant 16*b* and the photosensitive drum 11 is insufficient. Therefore, the lengths of the bristles are preferably within the above-described range.

The lubricant supplying roller 16*a* is rotated by a drive motor 45 so as to make contact with the photosensitive drum 11 rotating clockwise in FIG. 2 in the counter direction (i.e., the lubricant supplying roller 16*a* is rotated clockwise in FIG. 2). The lubricant supplying roller 16*a* (the bristles) is disposed so as to make a sliding contact with the solid lubricant 16*b* and the photosensitive drum 11. The lubricant supplying roller 16*a* rotates and scrapes the lubricant from the solid lubricant 16*b*, conveys the scraped lubricant to a sliding contact position with the photosensitive drum 11, and applies (supplies) the lubricant onto the photosensitive drum 11.

In the embodiment, the drive motor 45 is a speed variable motor and rotates only the lubricant supplying roller 16*a* independently from other drive motors (e.g., the drive motor 49 that rotates the photosensitive drum 11), and can adjust an amount of the lubricant supplied onto the photosensitive drum 11 by changing the revolution of the lubricant supplying roller 16*a*. That is, the drive motor 45 functions as an changing unit that changes the revolution of the lubricant supplying roller 16*a* to adjust the lubricant supplying amount, which is described later in detail.

The pressuring mechanism including the holding member 16*c*, the turning members 16*g*, the tension spring 16*h*, and a bearing 16*j* (each of them is also refereed to as the pressuring mechanism, e.g., the holding member 16*c* is disposed behind the solid lubricant 16*b* for eliminating an uneven contact of the solid lubricant 16*b* with the lubricant supplying roller 16*a*, and urges the solid lubricant 16*b* held (attached) on the holding member 16*c* toward the lubricant supplying roller 16*a*. More specifically, the pressuring mechanism (pressing device) includes the holding member 16*c*, a pair of turning members 16*g* rotatably held by the holding member 16*c*, the tension spring 16*h* (urging member) connected between the turning members 16*g*, and the bearing 16*j*.

In the embodiment, the solid lubricant 16*b* (lubricant member) is made of one containing mainly boron nitride and fatty acid metal salt.

The solid lubricant 16*b* containing boron nitride causes the lubricant on the photosensitive drum 11 to hardly deteriorate after the charging process and the transfer process are performed on the photosensitive drum 11 because characteristics of boron nitride are hardly changed by discharge. In addition, the solid lubricant 16*b* containing boron nitride can prevent the photosensitive drum 11 from oxidizing and vaporizing by discharge.

When lubricant containing only boron nitride is used, a uniform lubricant film may not be formed on the entire surface of the photosensitive drum 11 because the supplied lubricant does not entirely cover the surface of the photosensitive drum 11. For this reason, fatty acid metal salt is combined with boron nitride in the solid lubricant 16*b*. As a result, a lubricant film can be effectively formed on the entire surface of the photosensitive drum 11, thereby enabling high lubricity to be maintained for a long period of time. Examples of fatty acid metal salt include a fluorine series resin, fatty acid metal salt having a lamella crystal structure (such as zinc stearate, calcium stearate, barium stearate, aluminum stearate, magnesium stearate), lauroyl lysine, sodium zinc salt of monocetyl phosphate ester, and calcium lauroyl taurine. Particularly, when zinc stearate as fatty acid metal salt easily spreads over the photosensitive drum 11. As a result, lubricity hardly deteriorates even when humidity changes because of low moisture absorbency of the lubricant.

Liquid materials such as silicone oils, fluorochemical oils, natural wax, and gas materials can be combined in the solid lubricant 16*b* as external additives besides fatty acid metal salt and boron nitride.

The solid lubricant 16*b* thus structured is roughly classified into a press forming type and a melt forming type by the difference in manufacturing methods. The solid lubricant 16*b* of the press forming type is formed by pressing powder of lubricant while the solid lubricant 16*b* of the melt forming type is formed by melting the lubricant powder through heating and then cooling the melted lubricant. The solid lubricants 16*b* of both types can be attached to the lubricant supplying device 16 of the embodiment. In the embodiment, however, the solid lubricant 16*b* of the press forming type is used.

The solid lubricant 16*b* applied on the surface of the photosensitive drum 11 by the lubricant supplying roller 16*a*, coats the surface of the photosensitive drum 11 in a powder form, by which lubricity is not fully demonstrated. The blade-shaped member 16*d* (thin layer forming blade) thus functions as a member to uniformly distribute the lubricant. The blade-shaped member 16*d* forms a lubricant film on the photosensitive drum 11. As a result, the lubricant fully demonstrates the lubricity.

In this process, the blade-shaped member 16*d* forms a thinner film at a molecular level on the photosensitive drum 11 when powder of the lubricant applied by the lubricant supplying roller 16*a* is finer.

FIG. 3 is a perspective view illustrating a lubricant unit. As illustrated in FIG. 3, in the lubricant unit, the solid lubricant 16*b* is attached to the pressuring mechanism (pressing device) including the holding member 16*c*, a pair of turning members 16*g*, the tension spring 16*h* (urging member), and the bearing

16*j*. The lubricant unit is attachable to and detachable from (replaceable to) the lubricant supplying device 16 (process cartridge 10BK). As a result, replacement of the solid lubricant in the lubricant supplying device 16 (process cartridge 10BK) is easily performed.

As illustrated in FIG. 3, the solid lubricant 16*b* is adhesively attached to and held by the holding member 16*c*. Specifically, the holding member 16*c* holds the solid lubricant 16*b* by attaching it thereon with a double-sided adhesive tape or adhesive, for example, interposed therebetween. The holding member 16*c* is made of a metal plate, bent in a U-shape, and provided with a plurality of holes 16*c*2 on both side surfaces thereof to fix the bearings 16*j* used for holding the turning members 16*g*.

The pair of turning members 16*g* (pressing members) are supported by the holding member 16*c* at positions apart from each other in the width direction of the holding member 16*c* (the perpendicular direction to FIG. 2) so as to be rotatable. The pair of turning members 16*g* rotate in respective certain directions by urging force of the tension spring 16*h*, indirectly push the solid lubricant 16*b* with the holding member 16*c* interposed therebetween, and cause the solid lubricant 16*b* to press the lubricant supplying roller 16*a*.

Specifically, both side surfaces of each turning member 16*g* have axes 16*g*1 (axis sections) functioning as a rotational center. The axes 16*g*1 of the turning members 16*g* are attached to the inner diameter sections of the respective bearings 16*j*, and then the bearings 16*j* holding the turning members 16*g* are fitted into the respective holes 16*c*2. As a result, the turning members 16*g* are rotatably held by the holding member 16*c*. The turning members 16*c* are arranged on the holding member 16*c* so as to be symmetric in the width direction of the holding member 16*c*.

The turning members 16*g* are connected by the tension spring 16*h*. Specifically, hooked sections of both ends of the tension spring 16*h* are connected to the corresponding holes of the respective turning members 16*g*.

The tension spring 16*h* functions as an urging member that causes the pair of turning members 16*g* to rotate in different directions from each other so as to press the case 16*f* and urge the holding member 16*c* toward the lubricant supplying roller 16*a*. Specifically, the turning members 16*g* receive spring force (urging force) from the tension spring 16*h* in a direction along which cam-shaped sections (not illustrated) of the turning members 16*g* approach each other while making contact with the inner wall surface of the case 16*f*. As a result, the turning member 16*g* located on the left side in FIG. 3 is urged so as to rotate counter-clockwise with the axes 16*g*1 as the rotational center. In contrast, the turning member 16*g* located on the right side in FIG. 3 is urged so as to rotate clockwise with the axes 16*g*1 as the rotational center.

The characteristic structure and operation of the lubricant supplying device 16 (image forming apparatus 1) of the embodiment are described below in detail.

As illustrated in FIG. 2, in the lubricant supplying device 16 (image forming apparatus 1) of the embodiment, the drive motor 45 rotating the lubricant supplying roller 16*a* functions as the changing unit that adjusts the amount of lubricant supplied onto the photosensitive drum 11 from the lubricant supplying roller 16*a* (lubricant supplying amount) by changing the revolution (rotating speed) of the lubricant supplying roller 16*a*. Specifically, when it is intended to increase the lubricant supplying amount on the photosensitive drum 11, the drive motor 45 is controlled by a control unit 48 so as to increase the revolution of the lubricant supplying roller 16*a*. On the other hand, when it is intended to decrease the lubricant supplying amount on the photosensitive drum 11, the drive motor 45 is controlled by a control unit 48 so as to decrease the revolution of the lubricant supplying roller 16*a*. This is because the lubricant amount scraped from the solid lubricant 16*b* by the lubricant supplying roller 16*a* increases or decreases approximately in proportion to the increase or decrease in the revolution of the lubricant supplying roller 16*a*.

In the embodiment, the control unit 48 controls the drive motor 45 (changing unit) so as to change the revolution of the lubricant supplying roller 16*a* in accordance with the total running distance (or total operating time) of the lubricant supplying roller 16*a*. Specifically, the drive motor 45 is controlled so as to increase the revolution of the lubricant supplying roller 16*a* when the total running distance (or the total operating time) of the lubricant supplying roller 16*a* reaches a certain value.

Specifically, as illustrated in FIG. 4, when the lubricant supplying roller 16*a* (lubricant supplying device 16) at a virgin state starts being driven, the revolution of the lubricant supplying roller 16*a* is set to a standard value $\alpha$. The revolution a is maintained in an initial stage in which the total running distance of the lubricant supplying roller 16*a* reaches A km (e.g., 20 km). In a stage when a certain time has elapsed after the total running distance of the lubricant supplying roller 16*a* reaches A km, the drive motor 45 is controlled by the control unit 48 such that the revolution of the lubricant supplying roller 16*a* is more than the standard value $\alpha$ (e.g., $1.2\times\alpha$).

The total running distance (accumulated running distance) of the lubricant supplying roller 16*a* is calculated by an calculation unit of the control unit 48 on the basis of the accumulated operating time of the drive motor 45 independently driving the lubricant supplying roller 16*a*, the revolution of the lubricant supplying roller 16*a*, and the outer diameter of the lubricant supplying roller 16*a*, for example. The total running distance and the total operating time of the lubricant supplying roller 16*a* are factors convertible into each other even when the revolution is changed. Therefore, the control based on the total running distance of the lubricant supplying roller 16*a* can also be performed on the basis of the total operating time (the accumulated operating time of the drive motor 45) of the lubricant supplying roller 16*a*.

The reason why the revolution of the lubricant supplying roller 16*a* is changed in accordance with the total running distance (or the total operating time) of the lubricant supplying roller 16*a* is that the lubricant supplying amount fluctuates depending on the total running distance (or the total operating time) of the lubricant supplying roller 16*a* when the revolution of the lubricant supplying roller 16*a* is constant.

Figures 5, 6:
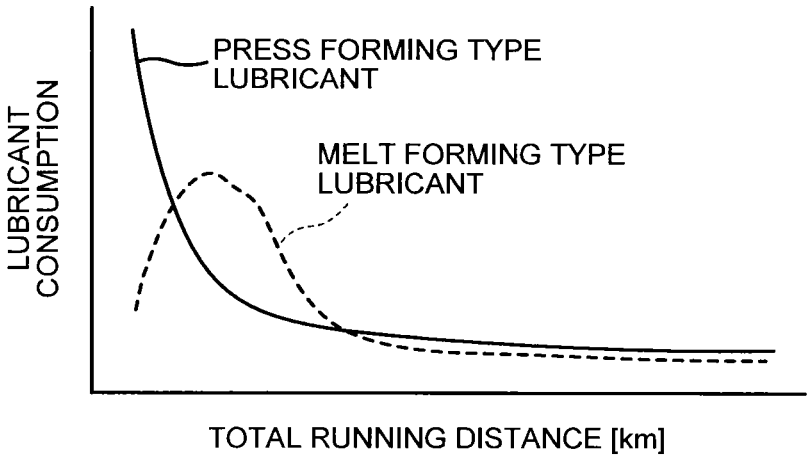
FIG. 5 is a graph illustrating a relationship between the total running distance and lubricant consumption.
FIG. 6 is a table relating to variable control of the revolution of the lubricant supplying roller in association with a change in absolute humidity.

FIG. 5 is a graph illustrating a relationship between the total running distance of the lubricant supplying roller 16*a* and the consumption (lubricant consumption) of the solid lubricant 16*b* when the revolution of the lubricant supplying roller 16*a* is constant. In both cases when the solid lubricant 16*b* of the press forming type and the solid lubricant 16*b* of the melt forming type are used, generally, the lubricant consumption decreases with an increase in the total running distance as time elapses from the initial stage and finally reaches a saturated state. This is because stiffness of the bristles of the lubricant supplying roller 16*a* weakens with the increase in the total running distance, thereby lowering the performance of scraping the solid lubricant 16*b*. The reason why the solid lubricant 16*b* of the press forming type and the solid lubricant 16*b* of the melt forming type have different lubricant consumption changes in the initial stage, is that time taken for the bristles of the lubricant supplying roller 16*a* to be adapted on the surface of the lubricant (to easily scrap the lubricant) differs in the initial stage for each type due to the difference in their hardness.

With such control, the lubricant supplying amount is prevented from being decreased, by increasing the revolution of the lubricant supplying roller 16*a* when the lubricant supplying amount from the lubricant supplying device 16 to the photosensitive drum 11 tends to decrease due to a decrease in the stiffness of the bristles of the lubricant supplying roller 16*a* over time. This reduces the occurrence of failures such as abrasion of the cleaning blade, cleaning failure, and filming due to the decrease in the lubricant supplying amount over time.

In the embodiment, relatively simple control is made in which the revolution of the lubricant supplying roller 16*a* is changed only one time as illustrated in FIG. 4 following the change in the lubricant consumption of FIG. 5 because the solid lubricant 16*b* of the press forming type is used.

On the other hand, when the solid lubricant 16*b* of the melt forming type is used, the revolution of the lubricant supplying roller 16*a* can be controlled to change at multiple stages following the fluctuation of the lubricant consumption of FIG. 5 (e.g., the revolution is controlled to increase, decrease, and increase in this order following the increase in the total running distance).

In the embodiment, as illustrated in FIG. 2, the calculation unit of the control unit 48 also functions as the calculation unit that obtains a product life (or total consumption) of the solid lubricant 16*b* from the total running distance of the lubricant supplying roller 16*a*. The control unit 48 (calculation unit) serving as the calculation unit corrects and calculates the product life (or the total consumption) of the solid lubricant 16*b* in accordance with the lubricant supplying amount changed by controlling the revolution of the drive motor 45 (changing unit). On the basis of the calculated product life (or the total consumption) of the solid lubricant 16*b*, various displays are made on a display panel (not illustrated) of the image forming apparatus 1. For example, a display indicating that replacement time of the solid lubricant 16*b* is approaching, and a display indicating that the solid lubricant 16*b* needs to be replaced are made.

The lubricant supplying device 16 of the embodiment performs adjustment control of the lubricant supplying amount by properly changing the revolution of the lubricant supplying roller 16*a* to reduce a decrease in the lubricant supplying amount over time. Therefore, if the product life (or the total consumption) of the solid lubricant 16*b* is calculated simply on the basis of the total running distance obtained in accordance with the revolution of the lubricant supplying roller 16*a*, the value of the product life or the total consumption includes a large error. Specifically, when the product life (or the total consumption) of the solid lubricant 16*b* is directly calculated from the total running distance obtained under the change condition of the revolution of the lubricant supplying roller 16*a* illustrated in FIG. 4, the product life is calculated to be shorter (or the total consumption is calculated to be larger). As a result, various problems occur. For example, a display indicating that the solid lubricant 16*b* needs to be replaced is made even before the replacement time and thus the solid lubricant 16*b* is replaced too early.

In contrast, such problems hardly occur according to the embodiment, because the product life (or the total consumption) of the solid lubricant 16*b* is calculated almost correctly by the correction taking into consideration the fluctuation of the lubricant supplying amount caused by the revolution control of the lubricant supplying roller 16*a*. Data of the lubricant supplying amount changing with the revolution control of the lubricant supplying roller 16*a* is preliminarily stored in a storage of the control unit 48. The data is obtained by experiments and simulations taking into consideration the changing characteristics of the lubricant consumption of the solid lubricant 16*b* illustrated in FIG. 5.

Such correction calculation is particularly useful when the lubricant supplying amount control of the lubricant supplying device 16 of the embodiment is performed on the basis of a plurality of factors such as environmental fluctuations, which are described next, and not performed on the basis of a single factor of the total running distance only.

In the embodiment, as illustrated in FIG. 2, an absolute humidity detection unit 41 is included that serves as a detection unit detecting a temperature and humidity corresponding to the temperature and humidity around the solid lubricant 16*b*.

As illustrated in FIG. 2, the absolute humidity detection unit 41 serving as the detection unit includes mainly a temperature sensor 42 that detects a temperature equivalent to the temperature around the solid lubricant 16*b* and a relative humidity sensor 43 that detects humidity equivalent to the humidity around the solid lubricant 16*b*. Specifically, the absolute humidity detection unit 41 (detection unit) sends the results of temperature and humidity detected by the temperature sensor 42 and the relative humidity sensor 43, respectively, to the control unit 48 and obtains the absolute humidity (amount of moisture) on the basis of a conversion table stored in the storage of the control unit 48 using the temperature and the humidity. An available temperature-humidity sensor in which the temperature and relative humidity sensors are integrated can be used as the temperature sensor 42 and the relative humidity sensor 43.

The absolute humidity detection unit 41 (detection unit) is preferably disposed at a position where a temperature and humidity corresponding to the temperature and the humidity around the solid lubricant 16*b* can be detected and that is far enough away from a position facing the photosensitive drum 11 for easily collecting an outer environment of the image forming apparatus 1 (e.g., a position not surrounded by heat-generating movable members or a heat-keeping space).

In the embodiment, the drive motor 45 (changing unit) is controlled so as to change the revolution of the lubricant supplying roller 16*a* on the basis of the temperature and humidity (absolute humidity) detected by the absolute humidity detection unit 41 serving as the detection unit to adjust the lubricant supplying amount onto the photosensitive drum 11.

Specifically, when the absolute humidity detected by the absolute humidity detection unit 41 is high, the drive motor 45 is controlled such that the revolution of the lubricant supplying roller 16*a* is increased and the lubricant supplying amount at the time is increased. In contrast, when the absolute humidity detected by the absolute humidity detection unit 41 is low, the drive motor 45 is controlled such that the revolution of the lubricant supplying roller 16*a* is decreased and the lubricant supplying amount at the time is decreased.

Specifically, as illustrated in FIG. 6, when the absolute humidity of a moderate value (e.g., 10 to 15 g/cm$^3$) is detected, the control unit 48 controls the drive motor 45 such that the revolution of the lubricant supplying roller 16*a* is a standard value $\alpha$ (e.g., 200 rpm). When the absolute humidity of a low value (e.g., equal to or less than 10 g/cm$^3$) is detected, the control unit 48 controls the drive motor 45 such that the revolution of the lubricant supplying roller 16*a* is lower than the standard value $\alpha$ (e.g., $0.8\times\alpha$). When the absolute humidity of a high value (e.g., equal to or greater than 15 g/cm$^3$) is detected, the control unit 48 controls the drive motor 45 such that the revolution of the lubricant supplying roller 16*a* is higher than the standard value α (e.g., 1.2×α).

The reason why the lubricant supplying amount is increased and decreased in accordance with the height of absolute humidity in this way, is that although a correlation between the lubricant supplying amount and temperature or relative humidity is not so strong, the correlation between the lubricant supplying amount and the absolute humidity is very strong in the environmental fluctuations.

Figure 7:
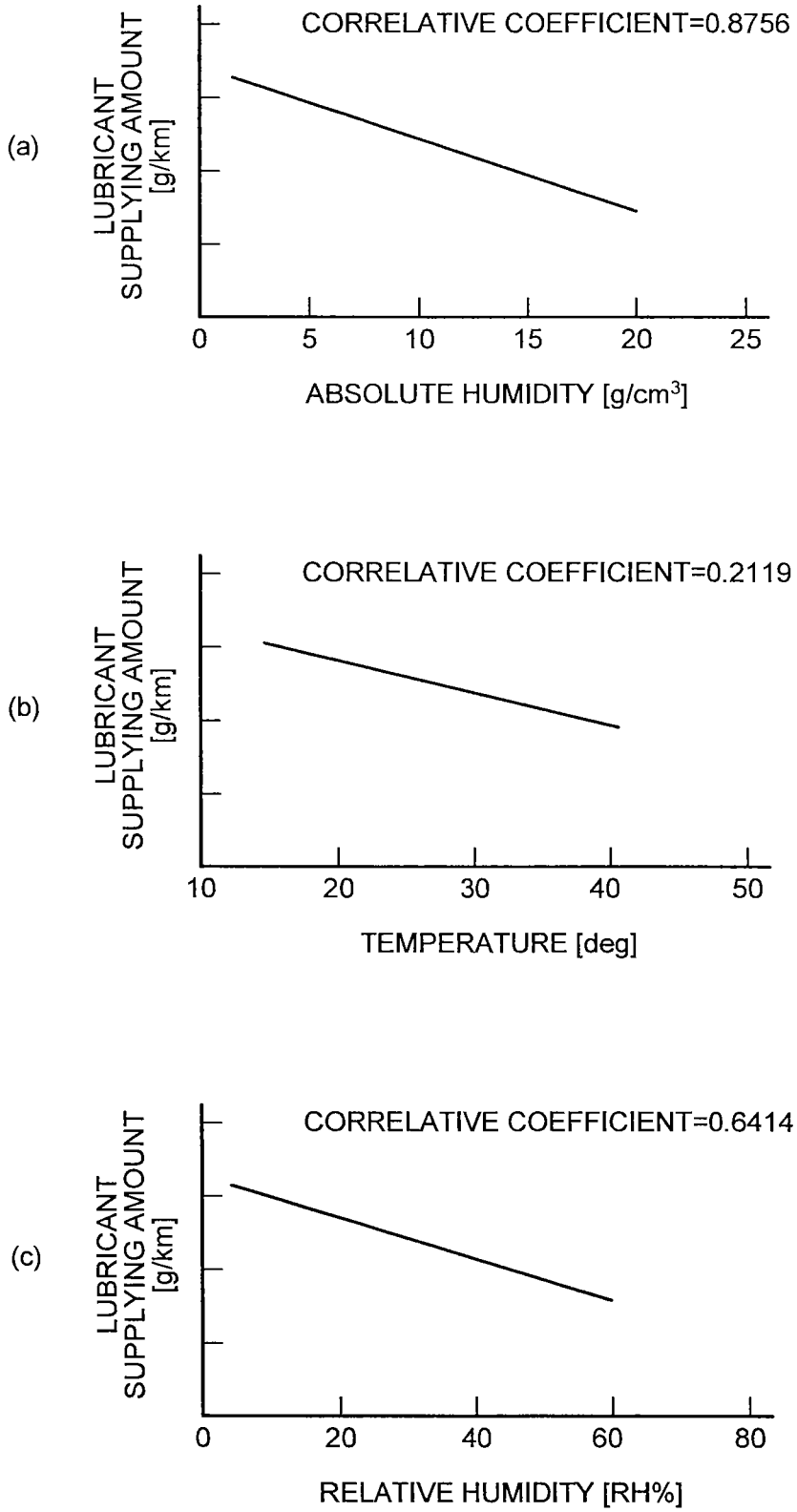
FIG. 7 illustrates graphs showing a relationship between the absolute humidity and a lubricant supplying amount, a relationship between temperature and the lubricant supplying amount, and a relationship between relative humidity and the lubricant supplying amount, respectively.

FIG. 7 illustrates graphs showing experimental results of changes of lubricant supplying amounts (lubricant consumption rates) caused by the environmental fluctuations in the lubricant supplying device 16 (image forming apparatus 1) of the embodiment. Illustrated in (a) of FIG. 7 is a relationship between the absolute humidity and the lubricant supplying amount. Illustrated in (b) of FIG. 7 is a relationship between the temperature and the lubricant supplying amount. Illustrated in (c) of FIG. 7 is a relationship between the relative humidity and the lubricant supplying amount.

It can be seen from the experimental results of FIG. 7 that a correlation between the lubricant supplying amount and the absolute humidity is very strong because the correlation coefficient of the graph (a linear function) representing the relationship between the absolute humidity and the lubricant supplying amount is "0.8756", which is closer to "1" than the correlation coefficients relating to the temperature and the relative humidity.

The reason why the absolute humidity particularly has a stronger correlation with the lubricant supplying amount than the correlation of the relative humidity with the lubricant supplying amount, is that an abrasion property of the solid lubricant 16*b* (easiness of being scraped by the lubricant supplying roller 16*a*) is considered to largely fluctuate depending on a slight difference in the moisture content rate of the solid lubricant 16*b* even if the lubricant has a low moisture content rate. The moisture content rate of the lubricant does not depend on the relative humidity, but depends on the absolute humidity, which indicates the amount of moisture in air. Therefore, it is considered that the absolute humidity has a stronger correlation with the lubricant supplying amount than the correlation of the relative humidity with the lubricant supplying amount. In addition, the stiffness of the bristles of the lubricant supplying roller 16*a* depends on the amount of the moisture. Therefore, it is considered that the stiffness of the bristles is weaker when the amount of moisture (absolute humidity) is large and a supplying performance (applying performance) of the lubricant onto the photosensitive drum 11 is lowered, while the stiffness of the bristles is stronger when the amount of moisture (absolute humidity) is small and the supplying performance (applying performance) of the lubricant onto the photosensitive drum 11 is enhanced. Therefore, absolute humidity and the lubricant supplying amount have a strong correlation.

The lubricant supplying amount does not fall below the lower limit of the supplying amount (a minimum supplying amount to be supplied onto the photosensitive drum 11 without being insufficient) even when the absolute humidity fluctuates, by controlling the drive motor 45 serving as the changing unit in accordance with the height of the absolute humidity (the result detected by the absolute humidity detection unit 41) corresponding to the absolute humidity around the image forming apparatus 1. This means a reduction in failures such as abrasion of the cleaning blade, cleaning failures, and filming caused by the shortage of the lubricant supplied onto the photosensitive drum 11 by the lubricant supplying device 16 even when the environmental fluctuations occur. Particularly, in the embodiment, control is performed such that the lubricant supplying amount is not excessive even when the absolute humidity is low. Therefore, various problems are reduced, such as a problem in that the product life of the solid lubricant 16*b* becomes shorter due to the excessive supply of the lubricant, and another problem in that the surface of the charging unit 12 (roller charging device) is contaminated by excessive lubricant adhering to the photosensitive drum 11.

In the same manner as afore-mentioned, the control unit 48 (calculation unit) corrects and calculates the product life or the total consumption of the solid lubricant 16*b* in accordance with the lubricant supplying amount changed by the revolution control of the drive motor 45. That is, the product life or the total consumption of the solid lubricant 16*b* is calculated almost correctly by the correction taking into consideration the fluctuation of the lubricant supplying amount caused by the revolution control of the lubricant supplying roller 16*a* based on the change in the absolute humidity.

In the embodiment, the control unit 48 (calculation unit) can calculate the product life or the total consumption of the solid lubricant 16*b* by correcting them so as not to be excessive or insufficient when the image forming apparatus 1 is operated under any of the following conditions (1) and (2). Condition (1): a winter environment in which humidity is low in a certain range (e.g., the absolute humidity is equal to or less than 7 g/cm$^3$), which is an assumed office environment in winter. Condition (2): a summer environment in which humidity is high in a certain range (e.g., the absolute humidity is equal to or greater than 15 g/cm$^3$).

Specifically, when used under the summer environment, the consumption of the lubricant may be controlled so as not to fluctuate with respect to the use under a standard environment (normal state) by increasing the revolution of the lubricant supplying roller 16*a*, because the consumed lubricant amount is decreased due to the environmental fluctuations.

When the product life of the lubricant is calculated on the basis of the revolution of the lubricant supplying roller 16*a* under such control, it takes a shorter period of time to reach a standard value by which the product life is determined because the revolution of the lubricant supplying roller 16*a* is increased while the consumption of the lubricant is the same as that under the standard environment. As a result, the product life of the lubricant is calculated to be shorter than the inherent product life.

The product life of the lubricant in use under the summer environment can be properly calculated in the following manner. The total running distance of the lubricant supplying roller 16*a* is multiplied by a correction coefficient of "0.8", which is illustrated in the column "summer environment" of FIG. 11, while "1.0" is a reference count value for the total running distance of the lubricant supplying roller 16*a* used for calculating the product life. As a result, the total running distance is calculated shorter (i.e., it takes a longer period of time to reach the standard value by which the product life is determined).

The environment can be detected using the above-described absolute humidity detection unit 41.

When in use under the winter environment, the consumption of the lubricant may be controlled so as not to fluctuate with respect to that in use under the standard environment (normal state) by decreasing the revolution of the lubricant supplying roller 16*a*, because the consumed lubricant amount is increased due to the environmental fluctuations.

When the product life of the lubricant is calculated on the basis of the revolution of the lubricant supplying roller 16*a* under such control, it takes a longer period of time to reach the standard value by which the product life is determined, because the revolution of the lubricant supplying roller 16*a* is decreased while the consumption of the lubricant is the same as that under the standard environment. As a result, the product life of the lubricant is calculated to be longer than the inherent product life.

The product life of the lubricant in use under the winter environment can be properly calculated in the following manner. The total running distance of the lubricant supplying roller 16*a* is multiplied by a correction coefficient of "1.2", which is illustrated in the column "(winter environment)+(revolution is changed)" of FIG. 11, while "1.0" is the reference count value for the total running distance of the lubricant supplying roller 16*a* used for calculating the product life. As a result, the total running distance is calculated to be longer (i.e., it takes a shorter period of time to reach the standard value by which the product life is determined).

In FIG. 11, the column "(winter environment)+(revolution is fixed)" is used for another embodiment.

Specifically, the cleaning blade 15*a* of the process cartridge 10BK of the embodiment eats into the photosensitive drum 11 to remove the non-transferred toner on the photosensitive drum 11. When used under a low temperature environment, an intrusion amount of the cleaning blade 15*a* into the photosensitive drum 11 is increased due to shrinkage by temperature change of material used for the process cartridge 10BK case, and problems such as an increase in the drive torque of the photosensitive drum 11 and a turning up of the cleaning blade 15*a* may occur.

In order to avoid such problems, friction coefficient of the surface of the photosensitive drum 11 can be controlled to lower under the winter environment by fixing the revolution of the lubricant supplying roller 16*a* to the same as that when used under the standard environment without decreasing the revolution with respect to the standard environment, and by increasing the consumption of the lubricant. When the product life of the lubricant is calculated on the basis of the revolution of the lubricant supplying roller 16*a* under such control, the product life of the lubricant is calculated to be longer than the inherent product life, because the revolution of the lubricant supplying roller 16*a* remains unchanged while the product life of the lubricant is decreased due to an increase in the consumption of the lubricant compared with that when in use under the standard environment.

The product life can be properly calculated when the consumption of the lubricant is further increased than that under the standard environment when in use under the winter environment in the following manner. The total running distance of the lubricant supplying roller 16*a* is multiplied by a correction coefficient of "1.2", which is illustrated in the column "(winter environment)+(revolution is fixed)" of FIG. 11, while "1.0" is the reference count value for the total running distance of the lubricant supplying roller 16*a* used for calculating the product life. As a result, the total running distance is calculated to be longer (i.e., it takes a shorter period of time to reach the standard value by which the product life is determined).

In the embodiment, the control unit 48 (calculation unit) can calculate the product life or the total consumption of the solid lubricant 16*b* by correcting the value so as to shorten the product life (or to increase the total consumption) when the image forming apparatus 1 is operated under any of the following conditions (1) to (3). Condition (1): a winter environment in which the temperature is low in a certain range (low temperature and high humidity), which is an assumed office environment in winter. Condition (2): continuous sheet feeding (also referred to as continuous copying). Condition (3): a "special mode" in which the lubricant supplying amount by the lubricant supplying device 16 is forcibly increased.

The "special mode" can be selected by a user or a maintenance person by operating a button on an operation panel 46 of the image forming apparatus 1 so as to reduce the occurrence of a failure such as white spots on an output image, when it occurs. When the special mode is selected, the revolution of the lubricant supplying roller 16*a* is forcibly increased and thus the lubricant supplying amount is increased.

The reason for performing such control is that the above-described three conditions are conditions under which the lubricant supplying amount tends to be insufficient, and under which possible operation conditions occur relatively frequently.

Normally, the occurrences of abrasion of the cleaning blade 15*a*, cleaning failure, and filming can be suppressed when the lubricant supplying amount is sufficient. However, when images having a high image area rate are continuously formed, a so-called fusion tends to occur on the photosensitive drum 11. This fusion is produced when an external additive (such as silica added to the toner for stabilizing the charged performance against environmental fluctuations and endurance fluctuations) generally added to the toner and that is not removed by the cleaning blade 15*a* forms a core of the fusion and toner adheres to the core. The fusion easily occurs under the condition when the tone supplying amount to the cleaning blade 15*a* is large. For example, printed material such as posters and catalogs having a relatively high image area rate are sometimes printed at about 1000 to 10000 sheets in a row in the printing machine market. When such a job is performed, an image failure such as fusion sometimes occurs. For addressing such a problem, the applying amount of the lubricant on the surface of the photosensitive drum 11 is further increased. As a result, slipperiness of the surface of the photosensitive drum 11 is enhanced and the occurrence of the external additive that is not removed by the cleaning blade 15*a* is suppressed, thereby enabling the prevention of fusion.

The product life of the lubricant can be determined on the basis of the total running distance of the photosensitive drum 11 (or the total operating time of the drive motor 49). Specifically, the product life of the lubricant is determined when the total running distance of the photosensitive drum 11 (or the total operating time of the drive motor 49) reaches a certain value.

When any of the above-described three conditions is detected, the total running distance of the photosensitive drum 11 operated under the detected condition is multiplied by the corresponding correction coefficient illustrated in FIG. 8. For example, when the special mode is selected in the normal use (not under the winter environment or continuous sheet feeding), the total running distance is multiplied by the correction coefficient of "1.45" assuming that the consumed lubricant amount is increased due to the special mode while the reference count value for the total running distance is "1.0". That is, correction calculation is performed so as to shorten the calculated product life corresponding to the increased consumed lubricant amount due to the execution of the special mode.

The winter environment can be detected by the absolute humidity detection unit 41 as described above. The continuous sheet feeding and the special mode can be detected by information input to the operation panel 46.

In the embodiment, when the image forming apparatus 1 is operated under two or more of the conditions (1) to (3), the product life or the total running consumption of the solid lubricant 16*b* is corrected and calculated by the control unit 48 (calculation unit) so as to shorten the product life (or increase the consumption) using a correction amount smaller than a sum of the correction amounts each of which is used for the individual condition as illustrated in FIG. 8. For example, when the continuous sheet feeding is performed under the winter environment (operated under the conditions (1) and (2)), the correction calculation is performed using the correction coefficient of "1.51", which is smaller than the value obtained by simply adding the correction coefficient of "1.32" under the winter environment to the correction coefficient of "1.24" under the continuous sheet feeding.

The image area rate and the continuous sheet feeding can be detected by job information input to the control unit 48. The special mode can be detected using information input to the operation panel 46 or information of the control unit 48 determining the revolution of the drive motor 49 for the photosensitive drum 11.

The reason why the correction calculation is performed is that the lubricant supplying amount is not decreased by the amount obtained by adding the lubricant supplying amounts each of which is decreased individually under the corresponding condition when two or more of the conditions (1) to (3) are combined, and the lubricant supplying amount can be adjusted without being excessive or insufficient by properly controlling the revolution of the lubricant supplying roller 16*a* for individual condition and combined conditions.

In the "special mode", the lubricant supplying amount can also be forcibly increased step-by-step or continuously. That is, when the "special mode" is selected on the operation panel 46, the increase amount of the lubricant supplying amount can be selected so as to be increased step-by-step or continuously. Specifically, when the size (level) of the special mode is selected to any level, the revolution of the lubricant supplying roller 16*a* is increased in accordance with that level.

In such a case, the product life or the total consumption of the solid lubricant 16*b* is corrected and calculated by the control unit 48 so as to shorten the product life (or increase the total consumption) in accordance with the increase amount of the lubricant supplying amount under the special mode, and the value thereof can be correctly obtained.

In the "special mode", control can be performed in such a manner that the revolution of the lubricant supplying roller 16*a* is not increased until the total running distance (or the total operating time) of the lubricant supplying roller 16*a* or the photosensitive drum 11 reaches a certain value (e.g., 20 km) even when the "special mode" is selected.

This is because the stiffness of the bristles of the lubricant supplying roller 16*a* is sufficiently strong in the initial stage and thus, a problem of a decrease in the lubricant supplying amount hardly occurs. Therefore, a problem of an excessive lubricant supplying amount due to the "special mode" mistakenly selected in the initial stage can be reliably prevented by performing the above-described control.

In the embodiment, the revolution of the lubricant supplying roller 16*a* can be variably controlled on the basis of the total running distance of the lubricant supplying roller 16*a* (or the total operating time of the drive motor 45), and on the basis of the total running distance of the photosensitive drum 11 (or the total operating time of the drive motor 49). Specifically, the drive motor 45 (changing unit) can also be controlled such that the revolution of the lubricant supplying roller 16*a* is increased step-by-step with the increase in the total running distance (or the total operating time) of the lubricant supplying roller 16*a* or the photosensitive drum 11.

More specifically, as illustrated in FIG. 9, when the lubricant supplying roller 16*a* (lubricant supplying device 16) at a virgin state or the photosensitive drum 11 starts being driven, the revolution of the lubricant supplying roller 16*a* is set to the standard value $\alpha$. The revolution a is maintained until the total running distance of the lubricant supplying roller 16*a* or the photosensitive drum 11 reaches A1 km (e.g., 10 km). The revolution of the lubricant supplying roller 16*a* is controlled by the control unit 48 so as to be a value higher than the standard value $\alpha$ (e.g., $1.1\times\alpha$) until the total running distance of the lubricant supplying roller 16*a* or the photosensitive drum 11 reaches A2 km (e.g., 150 km) from A1 km. In addition, the revolution of the lubricant supplying roller 16*a* is controlled by the control unit 48 so as to be a still higher value (e.g., $1.2\times\alpha$) until the total running distance of the lubricant supplying roller 16*a* or the photosensitive drum 11 reaches A3 km (e.g., 225 km) from A2 km. When the total running distance of the lubricant supplying roller 16*a* or the photosensitive drum 11 exceeds A3 km, the revolution of the lubricant supplying roller 16*a* is controlled by the control unit 48 so as to be a still higher value (e.g., $1.3\times\alpha$).

With such control, the lubricant supplying amount can be further minutely adjusted over time. As a result, the decrease in the lubricant supplying amount can be reliably prevented over time.

In the embodiment, the drive motor 45 (changing unit) can be controlled such that the revolution of the lubricant supplying roller 16*a* is increased only when the absolute humidity detected by the absolute humidity detection unit 41 serving as the detection unit is higher than a certain value.

Specifically, as illustrated in FIG. 10, when the absolute humidity of a low or a moderate value (a value of the absolute humidity does not reach the certain value) is detected, the drive motor 45 is controlled by the control unit 48 such that the revolution of the lubricant supplying roller 16*a* is the standard value $\alpha$. In contrast, when the absolute humidity of a higher value than the certain value is detected, the drive motor 45 is controlled by the control unit 48 such that the revolution of the lubricant supplying roller 16*a* is a higher value than the standard value $\alpha$ (e.g., $1.2\times\alpha$).

With such control, the lubricant supplying amount can be maintained so as not to fall below the lower limit of the supplying amount when the absolute humidity is high while the lubricant supplying amount is increased when the absolute humidity is low, which case differs from a case in which the control described with reference to FIG. 6 is performed. That is, failures such as abrasion of the cleaning blade, cleaning failure, and filming caused by the shortage of the lubricant supplied onto the photosensitive drum 11 by the lubricant supplying device 16 are reduced even when the environmental fluctuations occur.

Particularly, when the control illustrated in FIG. 10 is performed, the lubricant supplying amount can be reliably maintained at the amount larger than the lower limit of the supplying amount regardless of the fluctuation of the absolute humidity. As a result, a problem in that the photosensitive drum 11 easily deteriorates due to the occurrence of a charging hazard can be reliably prevented.

In the embodiment, the drive motor 45 is a speed variable motor and rotates only the lubricant supplying roller 16*a* independently from other drive motors (e.g., the drive motor 49 that rotates the photosensitive drum 11), and can adjust the amount of lubricant supplied onto the photosensitive drum 11 by changing the revolution of the lubricant supplying roller 16*a*. That is, in the embodiment, the drive motor 45 functions as the changing unit that adjusts the lubricant supplying amount by changing the revolution of the lubricant supplying roller 16*a*.

In contrast, the amount of the lubricant supplied onto the photosensitive drum 11 may also be adjusted by changing the force applied to the solid lubricant 16*b* to press the lubricant supplying roller 16*a*, for example, while the revolution of the lubricant supplying roller 16*a* is maintained constant. In such a case, the same effect as the embodiment can be achieved.

In the embodiment, the control unit 48 (calculation unit) can correct and calculate the product life or the total consumption of the solid lubricant 16*b* so as not to be excessive or insufficient when the image forming apparatus 1 is operated under any of the following conditions (1) and (2). Condition (1): a winter environment in which humidity is low in a certain range (e.g., the absolute humidity is equal to or less than 7 g/cm$^3$), which is an assumed office environment in winter. Condition (2): a summer environment in which humidity is high in a certain range (e.g., the absolute humidity is equal to or greater than 15 g/cm$^3$).

Specifically, under the summer environment, the product life of the lubricant is calculated to be shorter than the inherent product life (the product life is determined even though the sufficient amount of the lubricant remains) because the total running distance of the lubricant supplying roller 16*a* is the same as when under the standard environment while the consumed lubricant amount is decreased due to the environmental fluctuations. The product life when used under the summer environment can be properly calculated in the following manner. The total running distance of the photosensitive drum 11 or the lubricant supplying roller 16*a* is multiplied by the correction coefficient of "0.8" while "1.0" is the reference count value for the total running distance used for calculating the product life, as illustrated in FIG. 11. As a result, the total running distance is calculated to be shorter (i.e., it takes a longer period of time to reach the standard value by which the product life is determined).

The environment can be detected using the above-described absolute humidity detection unit 41.

Under the winter environment, the product life of the lubricant is calculated to be longer than the inherent product life (the product life is determined after a while when no lubricant remains) because the total running distance of the lubricant supplying roller 16*a* is the same as that under the standard environment while the consumed lubricant amount is increased due to the environmental fluctuations.

The product life in use under the winter environment can be properly calculated by multiplying the total running distance of lubricant supplying roller 16*a* by the correction coefficient of "1.2" while "1.0" is the reference count value for the total running distance used for calculating the product life, as illustrated in FIG. 11. As a result, the total running distance is calculated to be longer (i.e., it takes a shorter period of time to reach the standard value by which the product life is determined).

As described above, according to the embodiment, the lubricant supplying amount onto the photosensitive drum 11 (image carrier) is adjusted by changing the revolution of the lubricant supplying roller 16*a*, and the product life or the total consumption of the solid lubricant 16*b* calculated by the total running distance (or the total operating time) of the lubricant supplying roller 16*a* or the photosensitive drum 11 is corrected in accordance with the adjusted lubricant supplying amount. As a result, the lubricant can be consistently and stably supplied onto the photosensitive drum 11 without being insufficient of the lubricant supplied onto the photosensitive drum 11 even when the environmental fluctuations occur over time, and the product life or the total consumption of the solid lubricant can be obtained correctly.

In the embodiment, each component of the image forming unit (the photosensitive drum 11, the charging unit 12, the developing unit 13, the cleaning unit 15, and the lubricant supplying device 16) are integrated to structure each of the process cartridges 10Y, 10M, 10C, and 10BK, thereby achieving the compact image forming unit and improving the maintenance workability. In contrast, each component of the image forming unit (the photosensitive drum 11, the charging unit 12, the developing unit 13, the cleaning unit 15, and the lubricant supplying device 16) can be individually mounted on the image forming apparatus 1 so as to be replaceable without being included as the component of the process cartridge. In such a case, the same effect as the embodiment can be achieved.

In the embodiment, the "process cartridge" is defined as the unit in which at least one of the charging unit that charges the image carrier, the developing unit (developing device) that develops the latent image formed on the image carrier, and the cleaning unit that cleans the surface of the image carrier is integrated with the image carrier, and is attached to the image forming apparatus so as to be detachable.

In the embodiment, the invention is applied to the image forming apparatus including the developing unit 13 employing the two-component developing method using two-component developer. The invention can also be applied to an image forming apparatus including the developing unit 13 employing a single-component developing method using single-component developer.

In the embodiments, the invention is applied to the tandem type color image forming apparatus using the intermediate transfer belt 17. The invention can also be applied to other image forming apparatuses such as a tandem color image forming apparatus using a transfer conveying belt (toner images on a plurality of photosensitive drums arranged in parallel so as to face the transfer conveying belt are transferred and superimposed on a recording medium conveyed by the transfer conveying belt) and a monochrome image forming apparatus. In such a case, the same effect as the embodiment can be achieved.

In the embodiment, the invention is applied to the lubricant supplying device 16 supplying the lubricant onto the photosensitive drum 11 serving as the image carrier. The invention can be applied to a lubricant supplying device that supplies the lubricant onto an image carrier besides the photosensitive drum 11 (e.g., a lubricant supplying device supplying the lubricant onto the intermediate transfer belt 17). In such a case, the same effect as the embodiment can be achieved by correcting the product life or the total consumption of the solid lubricant calculated from the total running distance or the total operating time of the lubricant supplying roller in accordance with the adjusted lubricant supplying amount in the same manner as the embodiment.

In the embodiment, the brush roller that has bristles provided around the periphery thereof is used as the lubricant supplying roller 16*a*. A sponge-like roller that has a sponge-like member (elastic material) provided around the periphery thereof can also be used as the lubricant supplying roller 16*a*. In such a case, the lubricant supplying amount is decreased in the same manner as the brush roller due to a decrease in elasticity of an elastic layer of the sponge-like member (elastic material) over time, and thus the same effect as the embodiment can be achieved by correcting the product life or the total consumption of the solid lubricant calculated from the total running distance or the total operating time of the lubricant supplying roller in accordance with the adjusted lubricant supplying amount in the same manner as the embodiment.

In the embodiment, the invention is applied to the apparatus in which the drive motor 45 driving the lubricant supplying roller 16*a* is provided independently from other drive systems. The invention can also be applied to any apparatus in which the revolution of the lubricant supplying roller 16*a* is controlled in the same manner as the embodiment though the drive motor 45 driving the lubricant supplying roller 16*a* is in common with the other drive systems (e.g., an apparatus in which the drive motor 45 is in common with the drive system for the cleaning roller of the cleaning unit 15). In such a case, the same effect as the embodiment can be achieved.

According to the embodiments, the lubricant supplying amount onto the image carrier is adjusted by changing the revolution of the lubricant supplying roller, and the product life or the total consumption of the solid lubricant calculated from the total running distance or the total operating time of the lubricant supplying roller or the image carrier is corrected in accordance with the adjusted lubricant supplying amount. As a result, the lubricant supplying device that can supply lubricant consistently and stably onto the image carrier without being insufficient in the supplying amount of the lubricant supplied onto the image carrier even when environmental fluctuations occur and even over time, and that can correctly obtain the product life or the total consumption of the solid lubricant, further providing the process cartridge including the lubricant supplying device and the image forming apparatus including the process cartridge.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A lubricant supplying device comprising:

a lubricant supplying roller configured to rotate in a certain direction and makes a sliding contact with an image carrier on which a toner image is carried;

a solid lubricant arranged to slide in contact with the lubricant supplying roller;

a changing unit configured to change a revolution of the lubricant supplying roller to adjust an amount of the solid lubricant supplied onto the image carrier; and a calculation unit configured to obtain a product life or total consumption of the solid lubricant from a total running distance or total operating time of the image carrier or the lubricant supplying roller, the product life or the total consumption of the solid lubricant being corrected based on the amount of the solid lubricant supplied onto the image carrier.

2. The lubricant supplying device according to claim 1, wherein the changing unit changes the revolution of the lubricant supplying roller based on the total running distance or the total operating time of the image carrier or the lubricant supplying roller.

3. The lubricant supplying device according to claim 2, wherein the changing unit increases the revolution of the lubricant supplying roller when the total running distance or the total operating time of the image carrier or the lubricant supplying roller reaches a certain value.

4. The lubricant supplying device according to claim 2, wherein the changing unit increases the revolution of the lubricant supplying roller step-by-step with an increase in the total running distance or the total operating time of the image carrier or the lubricant supplying roller.

5. The lubricant supplying device according to claim 1, further comprising a detection unit configured to detect absolute humidity, wherein the changing unit changes the revolution of the lubricant supplying roller based on the absolute humidity detected by the detection unit.

6. The lubricant supplying device according to claim 5, wherein the changing unit increases the revolution of the lubricant supplying roller when the absolute humidity is higher, and decreases the revolution of the lubricant supplying roller when the absolute humidity is lower.

7. The lubricant supplying device according to claim 5, wherein the changing unit increases the revolution of the lubricant supplying roller when the absolute humidity is higher than a certain value.

8. The lubricant supplying device according to claim 1, wherein the calculation unit obtains the corrected product life or the corrected total consumption of the solid lubricant such that the product life of the solid lubricant is shorter or the total consumption of the solid lubricant is larger when an image forming apparatus including the lubricant supplying device is operated under at least one of a winter environment condition in which temperature is low in a certain range, a continuous sheet feeding condition, and a special mode condition in which the lubricant supplying amount of the lubricant supplying device is forcibly increased.

9. The lubricant supplying device according to claim 8, wherein when the image forming apparatus is operated under two or more of the three conditions, the calculation unit obtains the corrected product life or the corrected total consumption of the solid lubricant such that the product life of the solid lubricant is shorter or the total consumption of the solid lubricant is larger, using a correction amount smaller than a sum of the correction amounts used for the respective two or more conditions.

10. The lubricant supplying device according to claim 1, wherein a special mode in which the lubricant supplying amount of the lubricant supplying device is forcibly increased step-by-step or continuously is selectable, and the calculation unit obtains the corrected product life or the corrected total consumption of the solid lubricant such that the product life of the solid lubricant is shorter or the total consumption of the solid lubricant is larger, based on the increased amount of the lubricant supplying amount under the special mode.

11. The lubricant supplying device according to claim 1, wherein the changing unit does not increase the revolution of the lubricant supplying roller until the total running distance or the total operating time of the lubricant supplying roller reaches a certain value even when the special mode in which the lubricant supplying amount of the lubricant supplying device is forcibly increased is selected.

12. A process cartridge, attached to an image forming apparatus so as to be detachable, the process cartridge comprising: the lubricant supplying device according to claim 1; and the image carrier.

13. An image forming apparatus comprising: the lubricant supplying device according to claim 1; and the image carrier.

* * * * *